US005521326A

United States Patent [19]

Sone

[11] Patent Number: 5,521,326

[45] Date of Patent: May 28, 1996

[54] KARAOKE APPARATUS SELECTIVELY SOUNDING NATURAL AND FALSE BACK CHORUSES DEPENDENTLY ON TEMPO AND PITCH

[75] Inventor: Takurou Sone, Hamamatsu, Japan

[73] Assignee: Yamaha Corporation, Hamamatsu, Japan

[21] Appl. No.: 340,155

[22] Filed: Nov. 15, 1994

[30] Foreign Application Priority Data

Nov. 16, 1993 [JP] Japan ..... 5-309765

[51] Int. Cl.[6] ..... G10H 1/02; G10H 1/36

[52] U.S. Cl. ..... 84/631; 84/636; 84/DIG. 4

[58] Field of Search ..... 84/602, 609–614, 84/631, 634–638

[56] References Cited

U.S. PATENT DOCUMENTS 5,294,746 3/1994 Tsumura et al. ..... 84/631

*Primary Examiner*—Stanley J. Witkowski
*Attorney, Agent, or Firm*—Loeb & Loeb

[57] ABSTRACT

A karaoke apparatus operates according to a song data for presenting a karaoke performance composed of an instrumental accompaniment and a back chorus under a designated condition determined in terms of either of a tempo and a pitch. In the karaoke apparatus, a data source provides a song data which contains a musical tone data, a synthetic voice data and a real voice data. An input panel is operated for designating either of a regular condition and an irregular condition. A tone generator processes the musical tone data to generate an instrumental accompaniment, and concurrently processes the synthetic voice data to generate a false back chorus. A voice decoder decodes the real voice data to reproduce a natural back chorus. A sequencer operates under the regular condition for effectuating the voice decoder to sound the natural back chorus along with the instrumental accompaniment, and otherwise operates under the irregular condition for suppressing the voice decoder to silence the natural back chorus while allowing tone generator to sound the false back chorus along with the instrumental accompaniment.

7 Claims, 5 Drawing Sheets

FIG. 2

| Header section | Track section | Voice section |
|---|---|---|
| Song number | Musical tone data track | Real voice data No.1 |
| Song title | Synthetic voice data track | Real voice data No.2 |
| Composer | Real voice designation data track | Real voice data No.3 |
| Singer | Lyric data track | Real voice data No.4 |
| Background image code | Effect control data track | |
| Font type | | |

FIG. 3

| Note event | Timbre change event | Pitch bend event |
|---|---|---|
| Channel number | Channel number | Channel number |
| Note number | Timbre data | Pitch bend information |
| Velocity | | |
| Note length | | |

FIG. 4

| Real voice event |
| --- |
| Real voice data code<br>Voice pitch<br>Voice volume |

FIG. 5

| | | | | | | | |
| --- | --- | --- | --- | --- | --- | --- | --- |
| Event | ⊿T | Event | Event | ⊿T | Event | Event | Event |

KARAOKE APPARATUS SELECTIVELY SOUNDING NATURAL AND FALSE BACK CHORUSES DEPENDENTLY ON TEMPO AND PITCH

BACKGROUND OF THE INVENTION

The present invention relates to a karaoke apparatus for presenting a karaoke performance involving a back chorus. More particularly, the invention relates to selective sounding of a real chorus voice and a synthetic chorus voice according to a tempo or a pitch of the karaoke performance.

A conventional karaoke apparatus of a musical tone synthesizer type is called a "tone generating karaoke" which is installed with a tone generator for synthesizing or generating musical tones of the karaoke performance according to a song data. The tone generating karaoke is advantageous in that the karaoke performance is presented by using a relatively small volume of the song data such as MIDI data. The tone generating type of the karaoke apparatus can facilitate scale-down and cost-down in contrast to an old musical tone reproduction type of the karaoke apparatus which utilizes a record medium such as an optical disk. The tone generating karaoke is further advantageous in that the song data can be provided through a telecommunication line.

The tone generating karaoke can present the karaoke performance composed of not only an instrumental accompaniment part, but also a back chorus part. In such a case, the karaoke apparatus stores a real voice data in the form of a coded digital waveform data provisionally sampled from sounds of a natural back chorus. In the karaoke performance, the real voice data is decoded to reproduce a natural back chorus sound. However, in this decoding method, the real voice data must be processed at a regular reproduction rate of the karaoke performance, i.e., a standard tempo. Therefore, if a karaoke song is performed at an irregular tempo other than the standard tempo, a timing deviation is caused between the back chorus part and the instrumental accompaniment part so that the back chorus cannot synchronize with the instrumental accompaniment. Further, a shift from a standard pitch of the karaoke performance may degrade a quality of the back chorus voice if the same is pitch-shifted accordingly.

SUMMARY OF THE INVENTION

In view of the above noted drawbacks of the prior art, an object of the invention is to provide an improved karaoke apparatus constructed to selectively utilize either of a natural chorus sound reproduced by decoding a digital voice waveform data and a substitute or false chorus sound synthesized by a tone generator, dependently on the reproduction rate of the karaoke performance. Another object of the invention is to selectively utilize either of the natural chorus sound and the false chorus sound dependently on a pitch shift degree of the karaoke performance.

According to a first aspect of the invention, a karaoke apparatus responds to a request for sounding a karaoke performance composed of an instrumental accompaniment and either of a false back chorus and a natural back chorus at a desired tempo according to a song data during the course of a physical singing. The karaoke apparatus comprises providing means responsive to a request for providing a requested song data which contains a musical tone data, a synthetic voice data and a real voice data which is sampled from a sound of a natural back chorus, tone generator means for processing the musical tone data to generate the instrumental accompaniment at a desired tempo, and for processing the synthetic voice data to generate the false back chorus at the same desired tempo, voice decoder means for decoding the real voice data to reproduce the natural back chorus at an original tempo, and control means operative when the desired tempo coincides with the original tempo for sounding the natural back chorus along with the instrumental accompaniment, and otherwise being operative when the desired tempo differs from the original tempo for selectively sounding the false back chorus along with the instrumental accompaniment while suppressing the natural back chorus.

According to a second aspect of the invention, a karaoke apparatus responds to a request for sounding a karaoke performance composed of an instrumental accompaniment and either of a false back chorus and a natural back chorus at a desired pitch according to a song data during the course of a physical singing. The karaoke apparatus comprises providing means responsive to a request for providing a requested song data which contains a musical tone data, a synthetic voice data and a real voice data which is sampled from a sound of a natural back chorus, tone generator means for processing the musical tone data to generate the instrumental accompaniment at the desired pitch, and for processing the synthetic voice data to generate the false back chorus at the desired pitch, voice decoder means for decoding the real voice data to reproduce the natural back chorus at an original pitch, adjusting means for adjusting the original pitch of the natural back chorus to the desired pitch by a certain shift amount, and control means operative when the shift amount is relatively small for sounding the natural back chorus along with the instrumental accompaniment, and otherwise being operative when the shift amount is relatively great for selectively sounding the false back chorus along with the instrumental accompaniment while suppressing the natural back chorus.

In a more generic form, a karaoke apparatus operates according to a song data for presenting a karaoke performance composed of an instrumental accompaniment and a back chorus under a designated condition determined in terms of either of a tempo and a pitch. The karaoke apparatus comprises providing means for providing a song data which contains a musical tone data, a synthetic voice data and a real voice data, commander means for designating either of a regular condition and an irregular condition, generator means for processing the musical tone data to generate an instrumental accompaniment, and for concurrently processing the synthetic voice data to generate a false back chorus, decoder means for decoding the real voice data to reproduce a natural back chorus, and control means operative under the regular condition for effectuating the decoder means to sound the natural back chorus along with the instrumental accompaniment, and being operative under the irregular condition for suppressing the decoder means to silence the natural back chorus while allowing the generator means to sound the false back chorus along with the instrumental accompaniment.

The real voice data represents a phrase chorus as it is. Therefore, the karaoke performance involving the natural back chorus can realistically present an original mood of the karaoke song. On the other hand, the synthetic voice data represents a rather simple and artificial voice tone such as "Wa-" which is successively generated in place of each real voice contained in the phrase chorus. Therefore, the artificial voice tone is sequentially presented along a melody of the back chorus, but does not have an original timbre of the natural back chorus. However, the tone generator is freely operated in synchronization with a desired tempo even if the same is different than the standard tempo. Therefore, the artificial voice tone can be generated synchronously with the musical tone of the instrumental accompaniment to avoid a timing gap between the instrumental accompaniment part and the back chorus part. In view of this, according to the first aspect of the invention, the natural back chorus is sounded at the standard or regular tempo, while the false back chorus is sounded at an irregular tempo other than the standard tempo. According to the second aspect of the invention, the real chorus voice is substituted by the synthetic voice tone when the karaoke performance is subjected to a substantial pitch shift from the standard pitch. If such a pitch shift is applied to the natural back chorus, its quality may suffer from serious degradation. The inventive apparatus can obviate the use of the degraded natural back chorus.

BRIEF DESCRIPTION OF THE DRAWINGS

FIG. 2 is a schematic diagram showing a format of a song data file provided to the karaoke apparatus.

FIG. 3 is a schematic diagram showing a detailed format of a musical tone data track contained in the song data file.

FIG. 4 is a schematic diagram showing a detailed format of a real voice data designation track contained in the song data file.

FIG. 5 is a schematic diagram showing a time-sequential data arrangement of each track contained in the song data file.

DETAILED DESCRIPTION OF THE INVENTION

Figure 1:
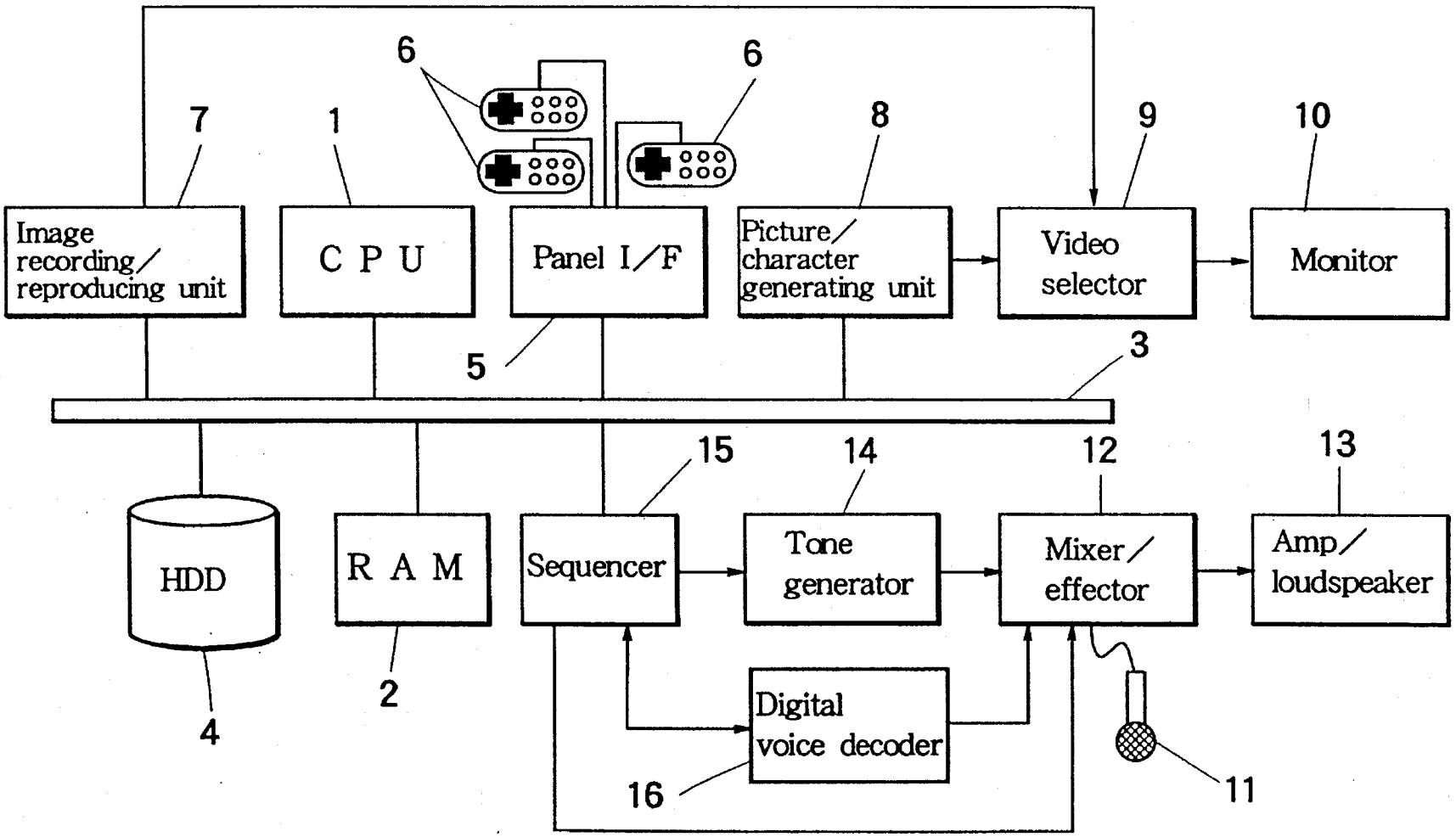
FIG. 1 is a block diagram showing one embodiment of the inventive karaoke apparatus.

Hereinafter, preferred embodiments of the invention will be described in detail with reference to the drawings. FIG. 1 is a block diagram showing an overall construction of one embodiment of the inventive karaoke apparatus. The apparatus includes a central processing unit (CPU) 1 for controlling and managing operation of an entire system of the karaoke apparatus. A random access memory (RAM) 2 is used when the CPU 1 controls and manages the operation of the entire system. A data and address bus line 3 is provided to build up the entire system.

The karaoke apparatus further includes a storage device such as a hard disk device (HDD) 4 for storing a plurality of song data files, a panel interface (I/F) 5, a plurality of input tools 6 including a remote controller for inputting commands to the system through the panel I/F 5, an image recording/reproducing unit 7 for recording and reproducing background images, a picture/character generating unit 8 for generating static background picture and lyric characters, a video selector 9 for selecting and composing the motion background images from the image recording/reproducing unit 7 and the static background pictures from the picture/character generating unit 8, and a monitor 10 for displaying the selected and composed images, pictures and characters.

The karaoke apparatus further includes a microphone 11 for picking up a physical singing voice of a karaoke player, a mixer/effector 12 for mixing the singing voices and musical tones of a performed karaoke song with each other and for imparting various acoustic effects thereto. An amp/loudspeaker 13 is provided to amplify and output the mixed singing voices and the musical tones. A tone generator 14 is provided to generate the musical tones of the karaoke song. A sequencer 15 is connected to control the tone generator 14 and the mixer/effector 12. The sequencer 15 contains a program ROM storing a program used by the CPU 1. A digital voice decoder 16 is provided to decode a coded digital voice data (real voice data) such as PCM data and ADPCM data.

In operation of the present karaoke apparatus, the input tool 6 is actuated to input a request command effective to designate a desired karaoke song to be performed. Then, the CPU 1 accesses the HDD 4 to retrieve therefrom a song data file containing a musical tone data, synthetic voice data and a real voice data of the designated karaoke song with reference to a stored entry song list. The retrieved song data file containing the real voice data which represents a natural back chorus is transferred to the RAM 2. Then, the control of the system is passed from the CPU 1 to the sequencer 15.

The sequencer 15 executes a plurality of events including an instrumental accompaniment and a back chorus in parallel manner based on a plurality of event data contained in the song data file. Namely, the sequencer 15 selectively distributes the musical tone data and the synthetic voice data to the tone generator 14, distributes the real voice data to the digital voice decoder 16, distributes a background image frame data to the image recording/reproducing unit 7, and distributes a lyric data to the picture/character generating unit 8. Consequently, the monitor 10 displays on its screen the background images while the lyric characters are superposed on a part of the background images. On the other hand, the amp/loudspeaker 13 outputs a karaoke performance containing the instrumental accompaniment and the back chorus.

Referring to FIG. 2, a format of the song data file is divided into a header section, a track section and a voice section. The header section contains prescribed information specific to one karaoke song, such as song number, song title, composer's name, singer's name, background image code and character font type of lyrics. The track section contains a plurality of tracks which prescribe a plurality of different events to be executed concurrently in parallel manner. The voice section contains a plurality of real voice data which are identified by phrase numbers and which are selected according to a real voice designation data prescribed in a real voice designation data track.

Among the various tracks, a musical tone data track contains a sequence of event data effective to enable the tone generator 14 to generate an instrumental accompaniment containing various musical tones. A synthetic voice data track contains a sequence of event data effective to enable the tone generator 14 to generate an artificial or false back chorus composed of rather simple voice tones such as "Wa-" and "U-". On the other hand, the real voice designation data track is prescribed with a real voice data code, an original key and a voice volume. The real voice data code designates a phrase of the natural back chorus such as "Hakodate-" and "Nagasaki-" which is to be reproduced by the decoder 16. The lyric data track is sequentially prescribed with character codes of a lyric to be displayed on the monitor along with the karaoke performance. The effect control data track is sequentially prescribed with a control data effective to control the mixer/effector 12.

FIG. 3 shows a detailed format of the musical tone data track. The musical tone data track is prescribed with various information including a note event, a timbre change event and a pitch bend event. The note event is defined by a channel number which designates one tone generating channel of the tone generator 14, a note number (i.e., tone pitch), a velocity (i.e., tone volume), and a note length. The timbre change event is defined by a channel number and a timbre data. The pitch bend event is defined a channel number and pitch bend information.

The synthetic voice data track has a similar format as that of the musical tone data track. The synthetic voice data track is prescribed with a voice event in place of the note event of the musical tone data track. The voice event is fed to a designated channel of the tone generator to generate a synthetic voice which is a variation of musical tones, while the note event is fed to another designated channel of the tone generator to generate a typical musical tone of the instrumental accompaniment.

FIG. 4 shows a detailed format of the real voice designation data track. The real voice designation data track contains various information of each real voice event, such as the real voice data code, the voice pitch and the voice volume. The real voice data code specifies one real voice data which is contained in the voice section of the song data file shown in FIG. 2.

Referring to FIG. 5, all of the track has the same construction where an event and a duration $\Delta t$ are alternately arranged with each other in time-sequential manner. The duration $\Delta T$ determines a duration time from a preceding event to a succeeding event.

Figure 6:
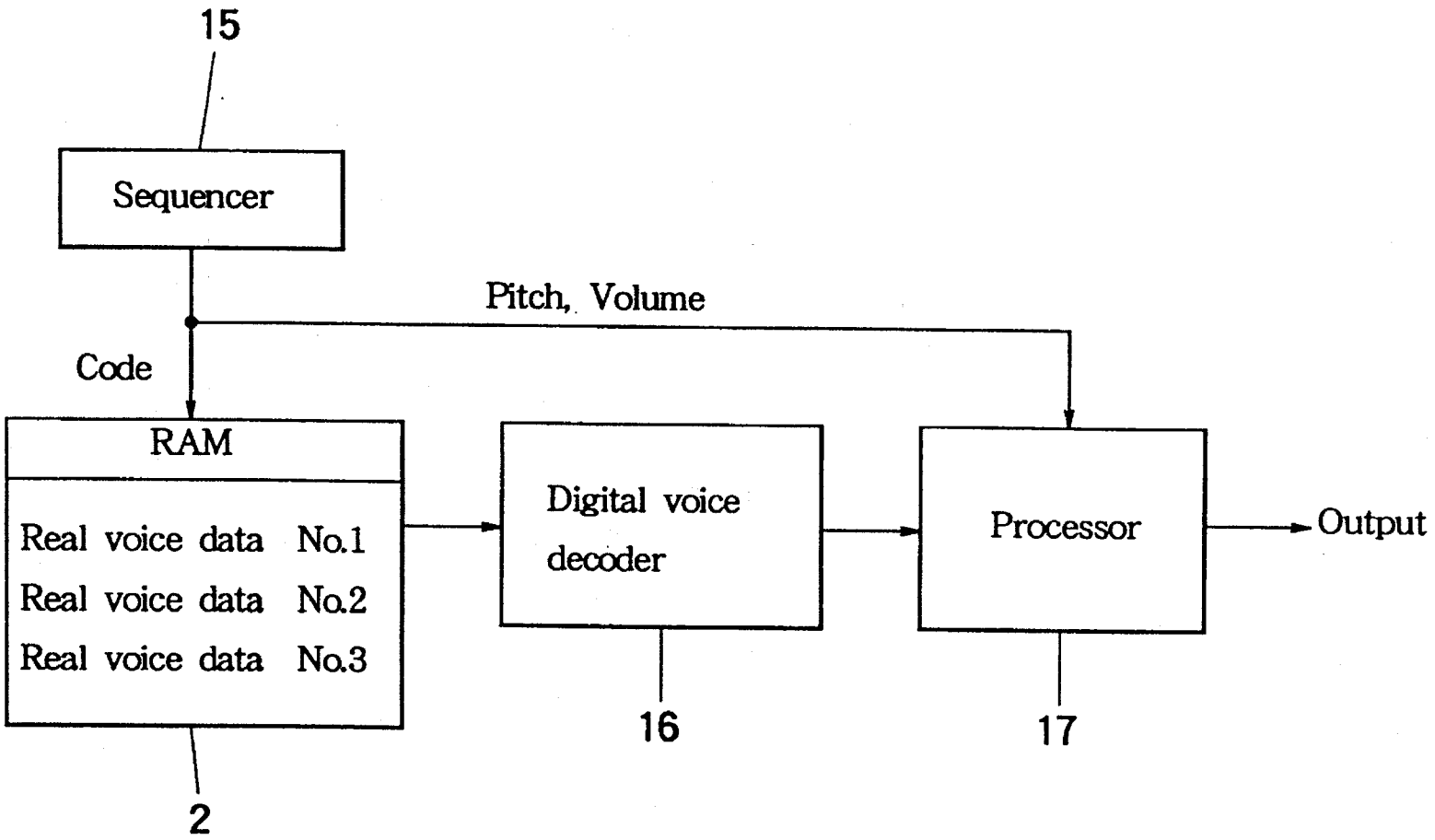
FIG. 6 is a block diagram showing a decoding part of the real voice data involved in the karaoke apparatus.

Referring to FIG. 6, the real voice data is decoded by the digital voice decoder 16 to reproduce a natural back chorus according to the voice event. The sequencer 15 retrieves from the RAM 2 a real voice data specified by the voice data code. The sequencer 15 further inputs the retrieved real voice data to the digital voice decoder 16. The real voice data represents the natural back chorus. For example, the real voice data may be a digitally coded waveform data such as Adaptive Delta Pulse Coded Modulation (ADPCM) data which has a compressed data volume. In such a case, the digital voice decoder 16 may be comprised of a PCM decoder effective to expand the ADPCM data by bit number conversion and frequency conversion to reproduce the natural back chorus.

A processor 17 is connected to the decoder 16 to receive therefrom a decoded analog waveform of the real voice data. The processor 17 adjusts a pitch and volume of the analog waveform according to the pitch and volume data contained in the voice event. Then, the adjusted waveform is fed to the mixer/effector 12 so as to reproduce the natural back chorus. However, the reproduction of the natural back chorus is effectuated only when the reproduction rate of the karaoke performance is set to 100% of an original rate, and only when the pitch adjustment by the processor 17 is limited within a predetermined range. In response to a desired tempo command inputted by means of the input tool 6 or else, the reproduction rate of the karaoke performance is changed other than 100% if the desired tempo does not coincide with a specified original or standard tempo of the requested song. In such a case, the processor 17 reduces the volume of the output of the decoder 16 to a zero level to inhibit or suspend sounding of the natural back chorus. In similar manner, the natural back chorus is suppressed when the pitch shift amount exceeds 200–300 cents of an original pitch or standard key. The natural back chorus is not sounded when the pitch is significantly shifted in order to avoid quality degradation of the karaoke performance. Namely, when a frequency of the voice waveform of the natural back chorus is changed over a moderate range by the processor 17, the quality of the real voice is degraded to hinder the karaoke performance. The moderate range may be ±two or three half tones (±200 or 300 cents). In view of this, the false back chorus is utilized instead of the natural back chorus when the pitch is changed over the predetermined range as well as when the tempo (reproduction rate) is changed from the standard or regular value. Consequently, under an irregular condition where the reproduction rate of the karaoke performance is set other than 100% or when the pitch shift amount exceeds 200–300 cents of the standard key, the sequencer 15 enables the tone generator 14 to generate the false or substitute back chorus according to the synthetic voice data contained in the karaoke song data file. The tone generator 14 has a specific channel assigned with a simple voice tone such as "Wa-" or "U-", while other channels are assigned with normal instrumental timbres. The specific channel is activated according to the sequence of the synthetic voice data to generate the false back chorus.

Figure 7:
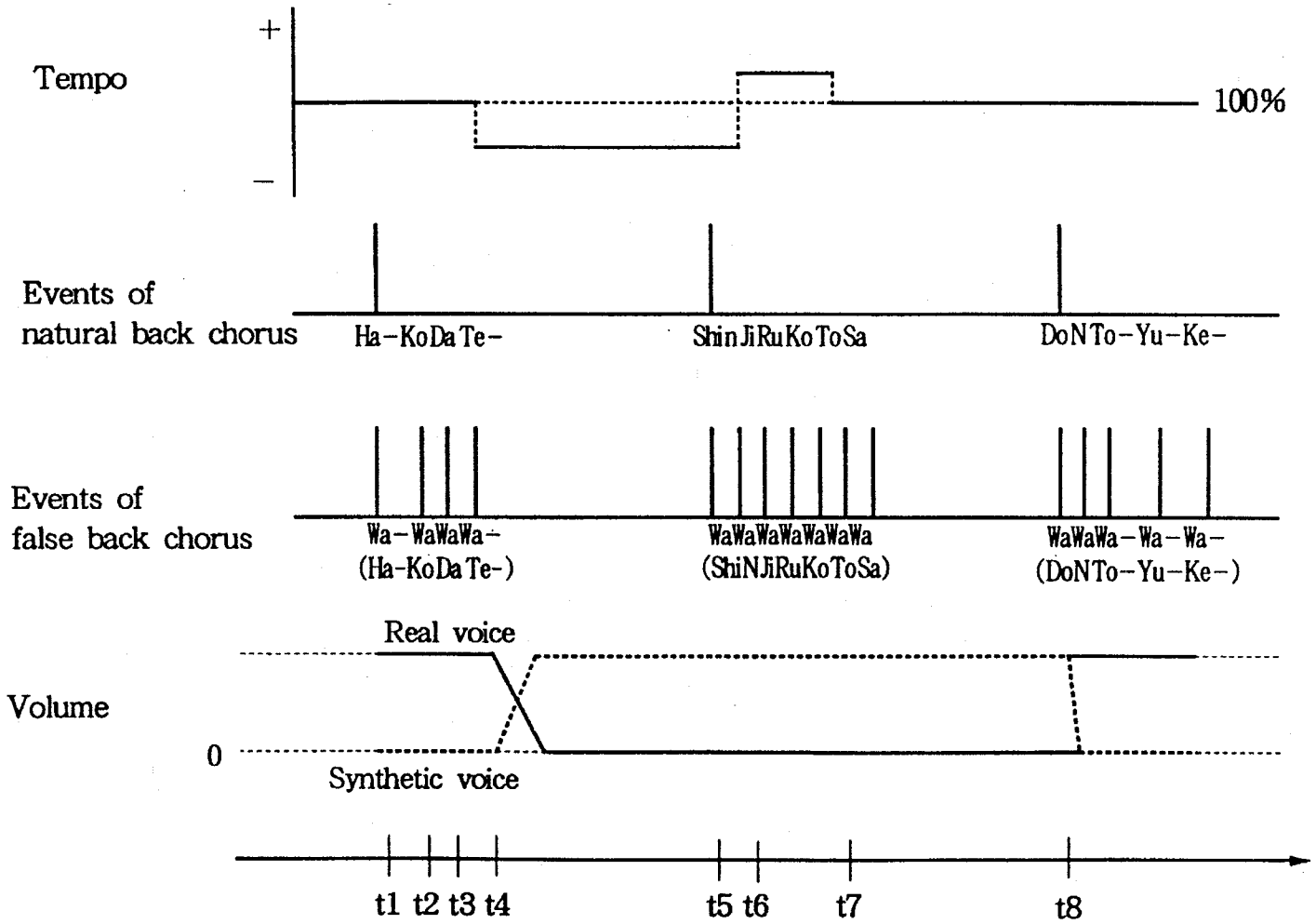
FIG. 7 is a timing chart showing a chorus sound control in the inventive karaoke apparatus.

FIG. 7 exemplifies a control sequence by the sequencer 15 during the karaoke performance while the reproduction rate is occasionally charged around 100% of the standard tempo. In this example, phrase events of the natural back chorus successively occur at timings t1, t5 and t8. On the other hand, the tempo is switched from 100% to 70% at a timing t4, then the tempo is further switched from 70% to 120% at a timing t6, and lastly the tempo returns from 120% to 100% at a timing t7.

At the timing t1, the tempo is set to 100% so that the voice decoder starts decoding of the real voice data representative of a natural back chorus phrase of a "Ha-KoDaTe-" according to the first event of the real voice designation data track. The volume of the reproduced phrase is controlled according to the volume data involved in the first event. In this period, the synthetic voice data track is processed by the tone generator in a silent state. Namely, a first voice event corresponding to the top voice "Ha-" of the chorus phrase is retrieved from the synthetic voice data track to generate a synthetic or substitute voice such as "Wa-" from the tone generator 14. However, an actual volume of the synthetic voice is set to a zero level so that the amp/loudspeaker 13 does not sound the substitute voice. Additionally, the volume of the natural back chorus is memorized for future use.

At a subsequent timing t2, the tempo is held at 100% so that the sounding of the first phrase of the natural back chorus continues. In this period, the synthetic voice data track enters a next voice event corresponding to "Ko" of the first phrase. However, the synthetic voice is held at the zero volume level. At a subsequent timing t3, the tempo is still kept at 100% so that the sounding of the first chorus phrase continues. In this period, the synthetic voice data track proceeds to a third voice event corresponding to "Da" of the first phrase. However, the synthetic voice is held silently.

At the timing t4, the tempo is lowered from 100% to 70% so that the real voice of the first phrase fades out. Instead, a substitute voice fades in from the specific channel of the tone generator. At this moment, cross-fading is effected between the real voice and the substitute voice in order to avoid sudden interruption of the natural back chorus.

At a further timing t5, the real voice designation data track proceeds to a next event of a second back chorus phrase "ShiNJiRuKoToSa". However, the tempo does not return to 100% so that the real voice is held in the silent state at the zero volume. Instead, the synthetic voice such as "Wa" is sounded from the tone generator 14 in place of a first voice "Shi" of the second chorus phrase. This synthetic voice is synthesized according to a channel number, a note number (tone pitch), a velocity (tone volume) and a note length, all of which are prescribed in the synthetic voice data track.

At a timing t6, the tempo is changed from 70% to 120% which exceeds 100%. Consequently, another substitute voice which sounds like "Wa" continues in place of a second voice "N" of the second chorus phrase. Subsequently at a timing t7, the tempo returns from 120% to 100% so that the substitute voice should be switched back to the real voice. However, at this moment, the sounding of the substitute voice is not stopped immediately, but is maintained for a while, until an occurrence of a next real voice event of a third chorus phrase.

At a timing t8, the tempo is maintained at 100%, and the next real voice event just starts. Thus, the real voice of the third chorus phrase "DoNTo-Yu-Ke-" fades in at this moment. The real voice may fade in rather quickly because the third chorus phrase is just started. On the other hand, synthetic voice corresponding to the real voice of "Do" is suspended by setting the associated channel of the tone generator to the zero volume.

By such an operation of the sequencer 15, the karaoke apparatus can present the karaoke performance with the back chorus part which always synchronizes with the instrumental accompaniment part while the reproduction rate is changed during the progression of the karaoke performance. In similar manner, the real voice is switched to the synthetic voice when the pitch shift amount exceeds the predetermined range under the control by the sequencer 15 including the program ROM, and the CPU 1.

In the disclosed embodiment, the natural back chorus is sounded when the tempo is set 100% and the false back chorus is sounded when the tempo is set other than 100%. However, in modification, the real voice and the synthetic voice may be mixed with each other to form a composite back chorus when the tempo is set 100% and the pitch shift is limited within a moderate range. On the other hand, when the tempo is set other than 100% or the pitch shift exceeds the moderate range, the real voice is suspended while the synthetic voice alone is effectuated. In such a case, a composite voice data track may contain both of a real voice designation data event and a synthetic voice data event.

As described above, according to the invention, the karaoke apparatus can present the karaoke performance composed of an instrumental accompaniment and a back chorus. The karaoke apparatus can be operated according to a performance condition in terms of a tempo or a pitch for selectively utilizing either of a natural back chorus reproduced by decoding a coded voice waveform data, and an artificial or false back chorus synthesized by the tone generator.

What is claimed is:

1. A karaoke apparatus responsive to a request for sounding a karaoke performance composed of an instrumental accompaniment and either of a false back chorus and a natural back chorus at a desired tempo according to a song data during the course of a physical singing, the apparatus comprising:

providing means responsive to a request for providing a requested song data which contains a musical tone data, a synthetic voice data and a real voice data which is sampled from a sound of a natural back chorus;

tone generator means for processing the musical tone data to generate the instrumental accompaniment at a desired tempo, and for processing the synthetic voice data to generate the false back chorus at the same desired tempo;

voice decoder means for decoding the real voice data to reproduce the natural back chorus at an original tempo; and control means operative when the desired tempo coincides with the original tempo for sounding the natural back chorus along with the instrumental accompaniment, and otherwise being operative when the desired tempo differs from the original tempo for selectively sounding the false back chorus along with the instrumental accompaniment while suppressing the natural back chorus.

2. A karaoke apparatus responsive to a request for sounding a karaoke performance composed of an instrumental accompaniment and either of a false back chorus and a natural back chorus at a desired pitch according to a song data during the course of a physical singing, the apparatus comprising:

providing means responsive to a request for providing a requested song data which contains a musical tone data, a synthetic voice data and a real voice data which is sampled from a sound of a natural back chorus;

tone generator means for processing the musical tone data to generate the instrumental accompaniment at the desired pitch, and for processing the synthetic voice data to generate the false back chorus at the desired pitch;

voice decoder means for decoding the real voice data to reproduce the natural back chorus at an original pitch;

adjusting means for adjusting the original pitch of the natural back chorus to the desired pitch by a certain shift amount; and control means operative when the shift amount is relatively small for sounding the natural back chorus along with the instrumental accompaniment, and otherwise being operative when the shift amount is relatively great for selectively sounding the false back chorus along with the instrumental accompaniment while suppressing the natural back chorus.

3. A karaoke apparatus operable according to a song data for presenting a karaoke performance composed of an instrumental accompaniment and a back chorus under a designated condition determined in terms of either of a tempo and a pitch, the apparatus comprising:

providing means for providing a song data which contains a musical tone data, a synthetic voice data and a real voice data;

commander means for designating either of a regular condition and an irregular condition;

generator means for processing the musical tone data to generate an instrumental accompaniment, and for concurrently processing the synthetic voice data to generate a false back chorus;

decoder means for decoding the real voice data to reproduce a natural back chorus; and control means operative under the regular condition for effectuating the decoder means to sound the natural back chorus along with the instrumental accompaniment, and being operative under the irregular condition for suppressing the decoder means to silence the natural back chorus while allowing the generator means to sound the false back chorus along with the instrumental accompaniment.

4. A karaoke apparatus according to claim 3; wherein the commander means includes means for inputting a desired tempo to set either of the regular condition where the inputted tempo coincides with a standard tempo which matches with the natural back chorus, and the irregular condition where the inputted tempo differs from the standard tempo.

5. A karaoke apparatus according to claim 3; wherein the commander means includes means for inputting a desired pitch to set either of the regular condition where the inputted pitch falls within a predetermined range allotted for the natural back chorus, and the irregular condition where the inputted pitch falls out of the predetermined range.

6. A karaoke apparatus according to claim 3; wherein the providing means includes means for providing the real voice data in the form of a coded waveform data sampled from a sound of the natural back chorus.

7. A karaoke apparatus according to claim 3; wherein the control means includes means for switching one of the false back chorus and the natural back chorus to the other in cross-fading manner when one of the regular condition and the irregular condition is changed to the other.

* * * * *